US012660884B2

(12) United States Patent
Suzuki

(10) Patent No.: US 12,660,884 B2
(45) Date of Patent: Jun. 23, 2026

(54) SHOE

(71) Applicant: ASICS CORPORATION, Kobe (JP)

(72) Inventor: Chihaya Suzuki, Hyogo (JP)

(73) Assignee: ASICS CORPORATION, Kobe (JP)

( * ) Notice: Subject to any disclaimer, the term of this patent is extended or adjusted under 35 U.S.C. 154(b) by 10 days.

(21) Appl. No.: 18/624,561

(22) Filed: Apr. 2, 2024

(65) Prior Publication Data

US 2024/0335007 A1 Oct. 10, 2024

(30) Foreign Application Priority Data

Apr. 6, 2023 (JP) ..... 2023-062149

(51) Int. Cl.
*A43C 9/00* (2006.01)
*A43B 23/02* (2006.01)

(52) U.S. Cl.
CPC ..... *A43C 9/00* (2013.01); *A43B 23/0265* (2013.01)

(58) Field of Classification Search
CPC ..... A43B 23/0245; A43B 23/04; A43C 1/00; A43C 1/06
See application file for complete search history.

(56) References Cited

U.S. PATENT DOCUMENTS 7,204,042 B2 4/2007 Aveni
7,293,371 B2 11/2007 Aveni
8,839,532 B2 9/2014 Huffa et al.
10,172,422 B2 1/2019 Podhajny et al.
2014/0237855 A1 8/2014 Podhajny et al.
2016/0095377 A1* 4/2016 Tamm ..... A43B 3/02 66/170
2016/0206044 A1 7/2016 Dimoff et al.
2017/0156445 A1* 6/2017 Guest ..... B29C 64/00
2018/0368506 A1* 12/2018 Bruce ..... A43B 1/04
2019/0082790 A1 3/2019 Podhajny et al.
2022/0007789 A1 1/2022 Corcoran-Tadd et al.
2023/0038383 A1 2/2023 Dua et al.

FOREIGN PATENT DOCUMENTS

JP 2016-182350 A 10/2016

OTHER PUBLICATIONS

The extended European search report issued by the European Patent Office on Sep. 19, 2024, which corresponds to European Patent Application No. 24166076.0-1015 and is related to U.S. Appl. No. 18/624,561.

* cited by examiner

*Primary Examiner* — Alissa L Hoey
*Assistant Examiner* — Akwokwo Olabisi Redhead
(74) *Attorney, Agent, or Firm* — Studebaker Brackett PLLC

(57) ABSTRACT

A shoe includes an upper member covering a foot, and a string-like body formed continuously with the upper member by the same thread as a thread forming the upper member. The string-like body can be a shoelace or an eyelet, or can fix the upper member to a sole member.

13 Claims, 11 Drawing Sheets

SHOE

REFERENCE TO RELATED APPLICATIONS

The present application claims priority to and incorporates by reference the entire contents of Japanese Patent Application No. 2023-062149 filed in Japan on Apr. 6, 2023.

BACKGROUND

1. Technical Field

The present disclosure relates to a shoe.

2. Background Information

As a shoe, there is a known shoe including a knitted upper member (see, for example, JP 2016-182350 A). This type of shoe is formed by a plurality of parts such as an upper member, a sole member, and a shoelace. Especially in performance shoes to be used in sports, a high fitting function is required as a function of an upper member in order to ensure close contact with a foot.

Meanwhile, it is desirable to reduce the number of parts and facilitate recycling in a shoe as described above from the perspective of reducing environmental burden. However, if, for example, all the parts are formed from a single material, the fitting function is reduced. Therefore, it has been difficult to ensure a fitting function, reduce manufacturing energy by reducing the number of parts, and improve recyclability.

The present disclosure has been made in view of the above, and an object thereof is to provide a shoe capable of ensuring a fitting function, reducing manufacturing energy by reducing the number of parts, and improving recyclability.

SUMMARY

In order to solve the above problem and achieve the object, a shoe comprising: an upper member, which covers a foot; and a string-like body, which is formed continuously with the upper member by the same thread as a thread that forms the upper member.

It is an object of the present disclosure to at least partially solve the problems in the conventional technology.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Hereinafter, embodiments of a shoe disclosed in the present application, will be described in detail with reference to the drawings. Note that, the shoe disclosed in the present application is not limited by the following embodiments.

First Embodiment

Figure 1:
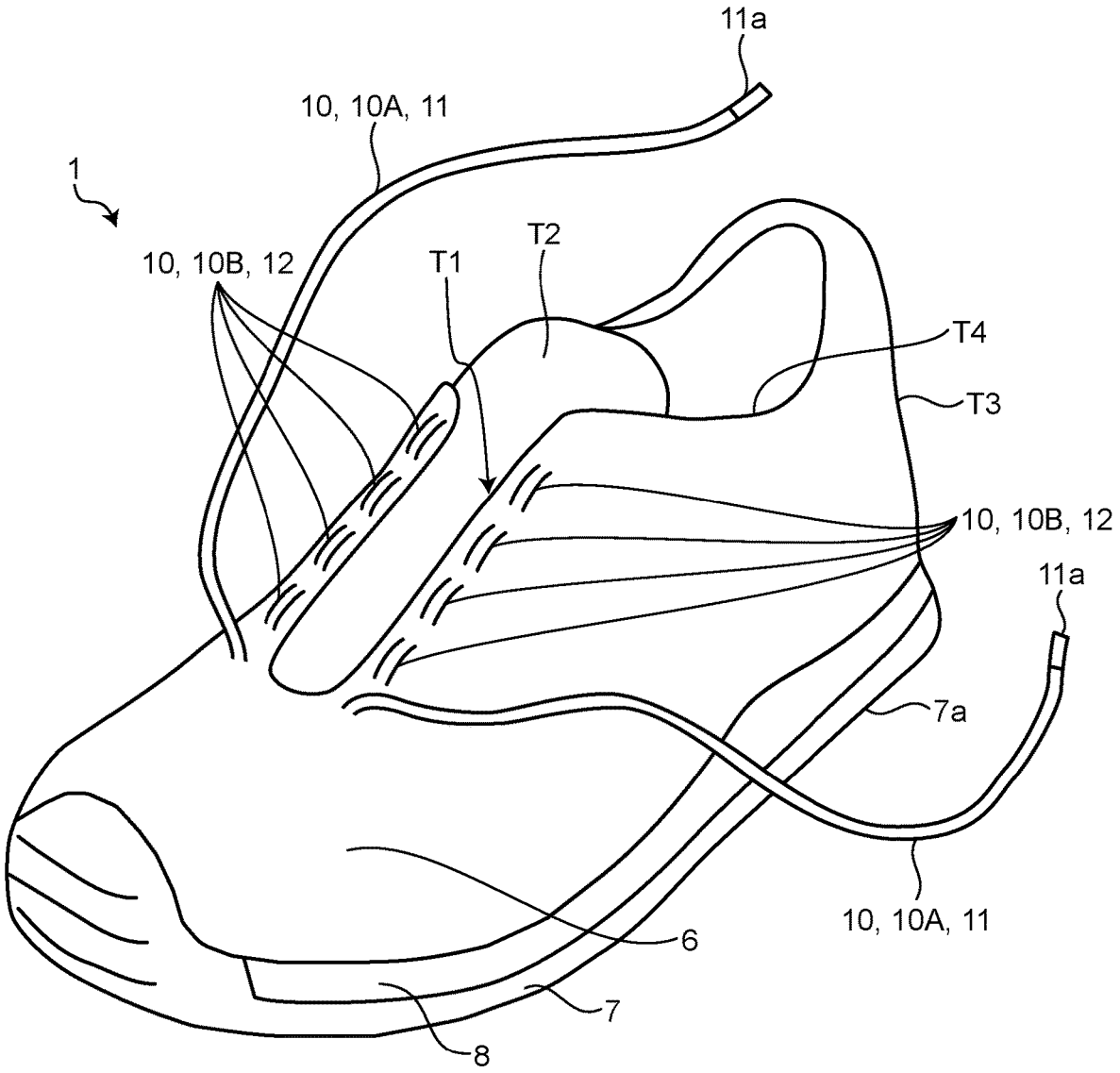
FIG. 1 is a perspective view illustrating an external appearance of a shoe according to a first embodiment.
Figure 2:
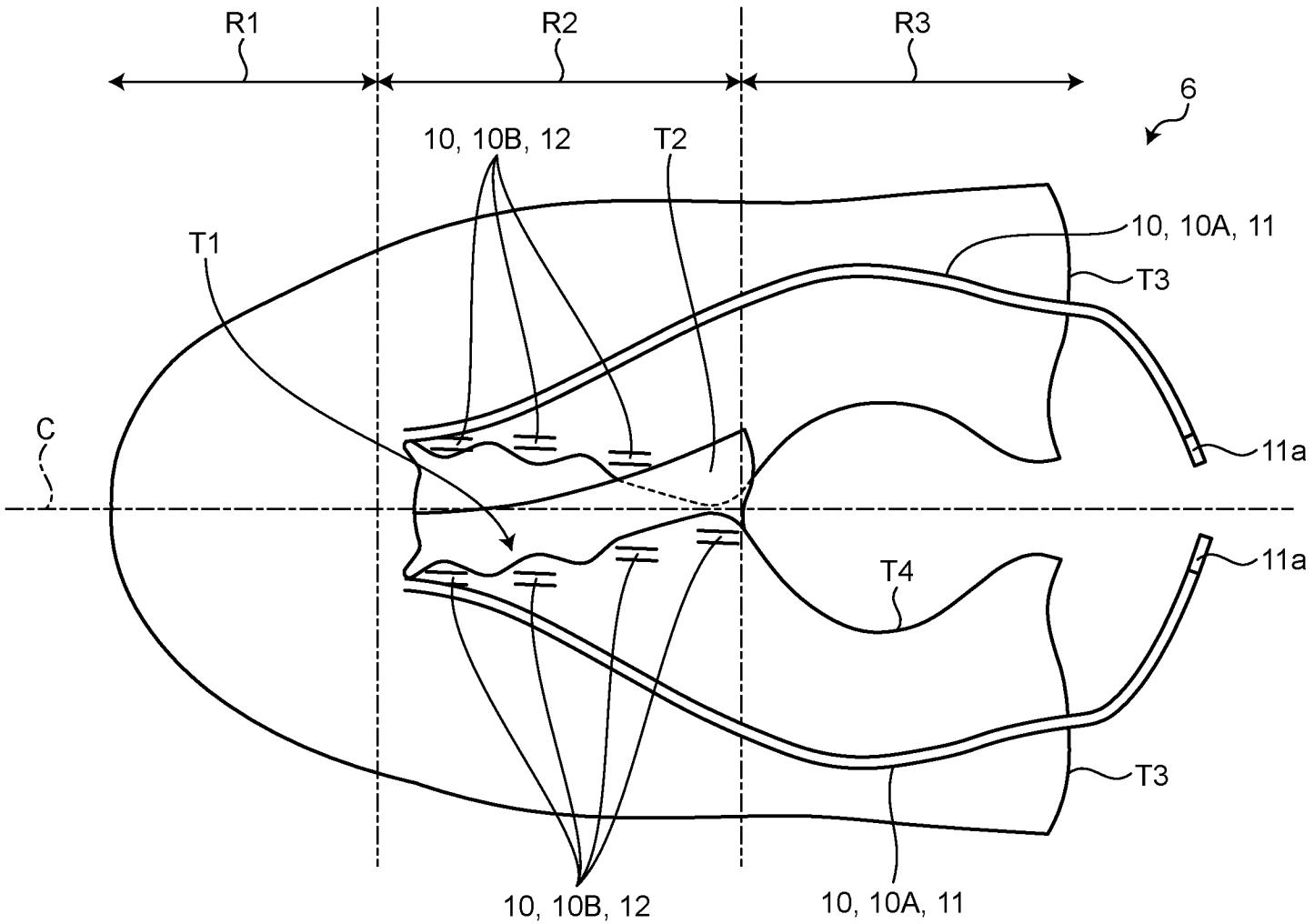
FIG. 2 is a developed view illustrating an upper member of the shoe according to the first embodiment.

FIG. 1 is a perspective view illustrating an external appearance of a shoe 1 according to a first embodiment. FIG. 2 is a developed view illustrating an upper member 6 of the shoe 1 according to the first embodiment. In the drawings including FIG. 1, only the shoe 1 for a left foot is illustrated. Since the shoe 1 has a left-right symmetrical structure for a left foot and a right foot, only the shoe 1 for a left foot is described in the present embodiment, and the description of the shoe 1 for a right foot is omitted. In the following description, a direction, in which a shoe center axis C, passing through the center of the shoe 1, extends in a plan view of the shoe 1, is referred to as a fore-rear direction, and a direction orthogonal to the fore-rear direction in a plan view of the shoe 1, is referred to as a foot width direction.

In addition, a direction from the heel toward the toe of the shoe 1 in the fore-rear direction, is referred to as a fore side, and a direction from the toe toward the heel of the shoe 1 in the fore-rear direction, is referred to as a rear side.

In addition, a median side of a foot in the anatomical position, is referred to as a medial foot side, and the side opposite to the median side of the foot in the anatomical position, is referred to as a lateral foot side. That is, the side closer to the median line in the anatomical position, is referred to as the medial foot side, and the side farther from the median line in the anatomical position, is referred to as the lateral foot side.

In addition, a vertical direction means a direction orthogonal to both the fore-rear direction and the foot width direction, unless otherwise specified.

The shoe 1 in the present embodiment is used as, for example, running shoes, other sports shoes, walking shoes, climbing shoes, and the like. As illustrated in FIGS. 1 and 2, the shoe 1 in the first embodiment includes an upper member 6 that covers a foot of a wearer, and a sole member 7 that covers the sole of the foot of the wearer.

The upper member 6 includes an upper fore foot portion R1 that covers a fore foot position of a foot (hereinafter, the foot is referred to as a standard foot) with a standard body shape, an upper mid foot portion R2 that covers a mid foot position of the standard foot, and an upper rear foot portion R3 that covers a rear foot position of the standard foot. The upper fore foot portion R1, the upper mid foot portion R2, and the upper rear foot portion R3 are disposed in this order in the fore-rear direction from the fore side of the upper member 6. In addition, the upper member 6 includes a U-shaped throat portion T1 that is open along the instep of the foot of the wearer, a tongue portion T2 that covers the instep of the foot of the wearer, a heel portion T3 that covers the heel of the foot of the wearer, and a foot insertion opening portion T4. The tongue portion T2 is disposed in the upper member 6 so as to close the throat portion T1.

The upper member 6 is disposed above the sole member 7. The upper member 6 is made of a cloth-like body including at least one layer and is, for example, a knitted fabric formed by a knitting machine. The shoe 1 in the embodiment includes a string-like body 10, which is formed continuously with the upper member 6 by the same thread as a thread S forming the upper member 6 (see FIGS. 3 and 4). In other words, the string-like body 10 is formed integrally with the cloth-like body by the same continuous thread S without cutting the thread S of the cloth-like body forming the upper member 6, and is formed in the same process as a forming process of the upper member 6.

Figure 3:
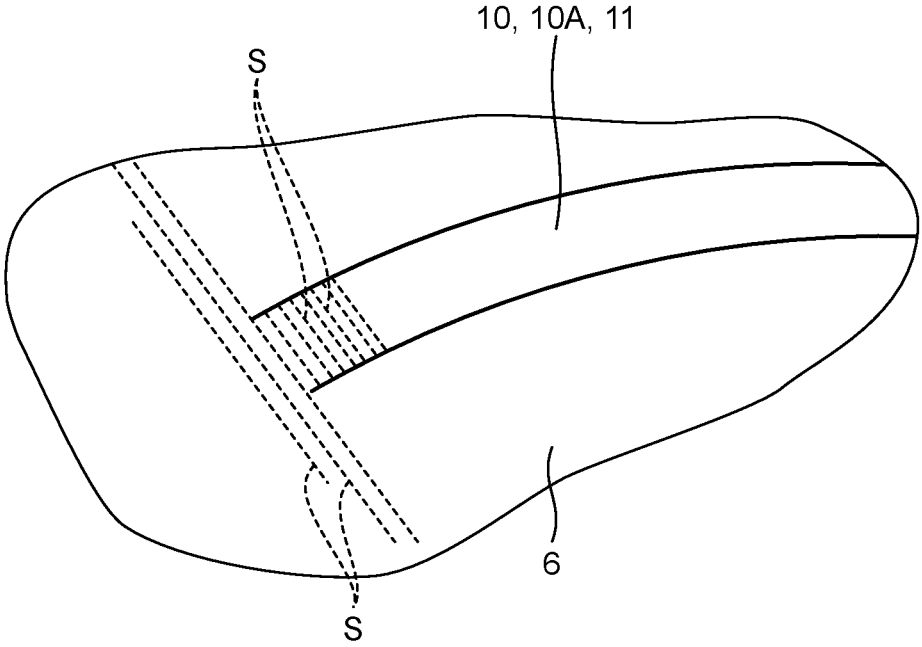
FIG. 3 is an enlarged view schematically illustrating an example of a string-like body in the first embodiment.
Figure 4:
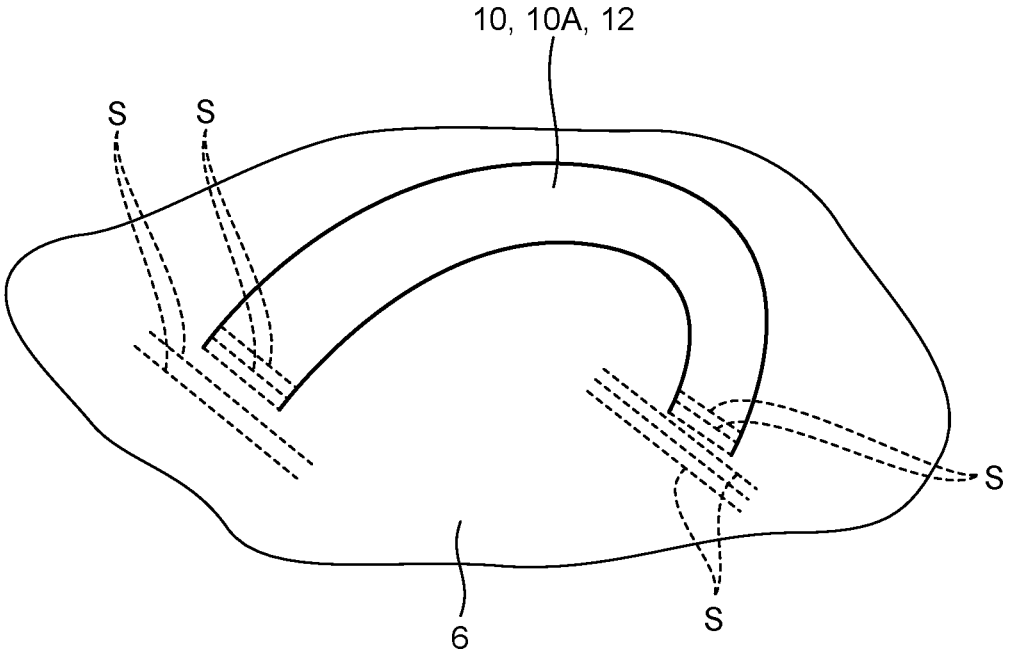
FIG. 4 is an enlarged view schematically illustrating another example of the string-like body in the first embodiment.

FIG. 3 is an enlarged view schematically illustrating an example of the string-like body 10 in the first embodiment. FIG. 4 is an enlarged view schematically illustrating another example of the string-like body 10 in the first embodiment.

As illustrated in FIGS. 3 and 4, the string-like body 10 of the shoe 1 includes two string-like bodies 10A, which are formed by extending from the vicinity of the opening edge of the throat portion T1 of the upper member 6, and a plurality of string-like bodies 10B, which are formed side by side along the opening edge of the throat portion T1.

The two string-like bodies 10A are shoelaces 11. Each string-like body 10A that serves as the shoelace 11, includes a tip portion 11*a* extended from the upper member 6, and the hardness of which is harder than that of a portion other than the tip portion 11*a*. The tip portion 11*a* of the string-like body 10A is solidified by, for example, a knitting structure, heating, an impregnating agent, or disposing a reinforcing material, such as a tube or tape, having higher hardness than that of the string-like body 10A. The high hardness of the tip portion 11*a* of the string-like body 10A allows easy handling when, for example, the shoelace 11 is passed through an eyelet 12.

The plurality of string-like bodies 10B are eyelets 12 through which the shoelaces 11 are passed. Each string-like body 10B that serves as the eyelet 12 is, for example, formed continuously with the upper member 6 by the same thread S forming the upper member 6 at the both ends in the length direction, but is not limited thereto. The string-like body 10B may have one end formed continuously with the upper member 6 and fixed by the other end by welding such as thermal fusion, sewing, or bonding, or a combination thereof.

In addition, the string-like bodies 10A that serve as the shoelaces 11 and the string-like bodies 10B that serve as the eyelets 12 may have different stretchability or tensile rigidity from each other. Here, the tensile rigidity refers to the hardness of the string-like body 10 under tension. That is, the string-like body 10 includes a plurality of types of string-like bodies 10A and 10B, which has different stretchability or tensile rigidity from each other. As a result, depending on the use of the string-like body 10, the appropriate stretchability or tensile rigidity can be achieved.

When a plurality of types of string-like bodies 10 is disposed in this manner, by changing the combination of threads S forming the string-like bodies 10, among a plurality of types of threads S forming the upper member 6, or by adding another thread S, it is possible to make the stretchability or the tensile rigidity different depending on the use of the string-like bodies 10 and the like. In addition, when a plurality of types of string-like bodies 10 is disposed, by, for example, making the cross-sectional areas or cross-sectional shapes of transverse sections orthogonal to the length direction of the string-like bodies 10 different, it is possible to make the stretchability or the tensile rigidity different. As a result, it is possible to appropriately adjust, for example, the frictional force generated in the string-like bodies 10 and the fitting function by the string-like bodies 10.

Note that the shoe 1 in the first embodiment includes both of the string-like bodies 10 of the string-like bodies 10A as the shoelaces 11 and the string-like bodies 10B as the eyelets 12, but may include only one of the string-like bodies 10. For example, the shoe 1 may include the eyelets 12 formed by the string-like bodies 10B, and a shoelace (not illustrated) separate from the upper member 6. Similarly, the shoe 1 may include the shoelaces 11 formed by the string-like bodies 10A, and eyelets (not illustrated) separate from the upper member 6.

In addition, the string-like bodies 10 are not limited to the use of the shoelaces 11 and the eyelets 12, and may be applied as, for example, a fitting member for improving the close contact of the upper member 6, the sole member 7, and the like with the foot, as in other embodiments described later.

The sole member 7 of the shoe 1 is what is called an outer bottom portion, and a lower surface of the sole member 7 serves as a ground contact surface 7*a* that is brought into contact with the ground. Between the sole member 7 and the upper member 6, a midsole member 8 having a cushioning property is disposed. The midsole member 8 is fixed on the sole member 7, and the upper member 6 is fixed on the midsole member 8. The sole member 7, the midsole member 8, and the upper member 6 are fixed by, for example, sewing, welding, or bonding, or a combination thereof. Although not illustrated, an insole member (inner sole member) is disposed between the midsole member 8 and the upper member 6. The inner sole member is disposed on an upper surface of the midsole member 8 and has a cushioning property. The sole member 7 may be formed integrally with the midsole member 8.

Effects of First Embodiment

As described above, the shoe 1 in the first embodiment includes the upper member 6 that covers a foot, and the string-like body 10, which is formed continuously with the upper member 6 by the same thread S as the thread S that forms the upper member 6. As a result, it is possible for the shoe 1 to ensure a fitting function, to reduce manufacturing energy by reducing the number of parts, and to improve recyclability.

In addition, the eyelets 12 of the shoe 1 in the first embodiment, are formed by the string-like bodies 10B having one ends, which is formed continuously on the upper member 6. As a result, the energy, required for a process of fixing the eyelets 12 to the upper member 6, is reduced, which reduces the environmental burden.

In addition, the eyelets 12 of the shoe 1 in the first embodiment, are formed by the string-like bodies 10B having both ends, which are formed continuously on the upper member 6. As a result, since the process of fixing the eyelets 12 to the upper member 6 is omitted, the energy, required for a manufacturing process of the shoe 1, is reduced, which reduces the environmental burden.

In addition, the string-like body 10 of the shoe 1 in the first embodiment includes a plurality of types of string-like bodies 10A and 10B, which has different stretchability or tensile rigidity from each other. As a result, it is possible to further improve the fitting function by a plurality of types of string-like bodies 10, since the appropriate stretchability or tensile rigidity can be achieved depending on the use of the string-like bodies 10.

In addition, each shoelace 11 of the shoe 1 in the first embodiment includes the tip portion 11*a*, which is extended from the upper member 6, and the hardness of which is higher than that of a portion other than the tip portion 11*a*. This allows easy handling when, for example, the shoelace 11 is passed through the eyelets 12.

Hereinafter, other embodiments will be described with reference to the drawings. In other embodiments, the same constituent members as those in the first embodiment are denoted by the same reference signs as those in the first embodiment, and the description thereof will be omitted. A shoe in each of second to fourth embodiments is different from that in the first embodiment in a structure of an upper member.

Second Embodiment

Figure 5:
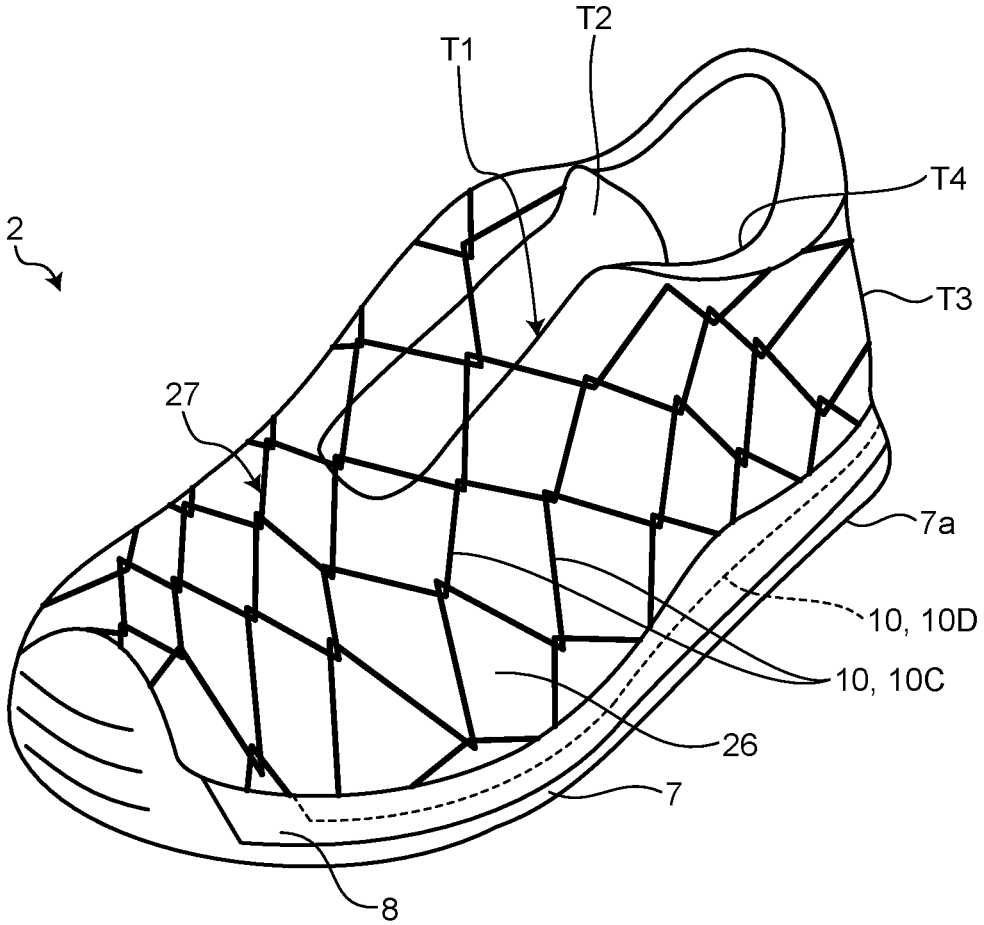
FIG. 5 is a perspective view illustrating a shoe according to a second embodiment.
Figure 6:
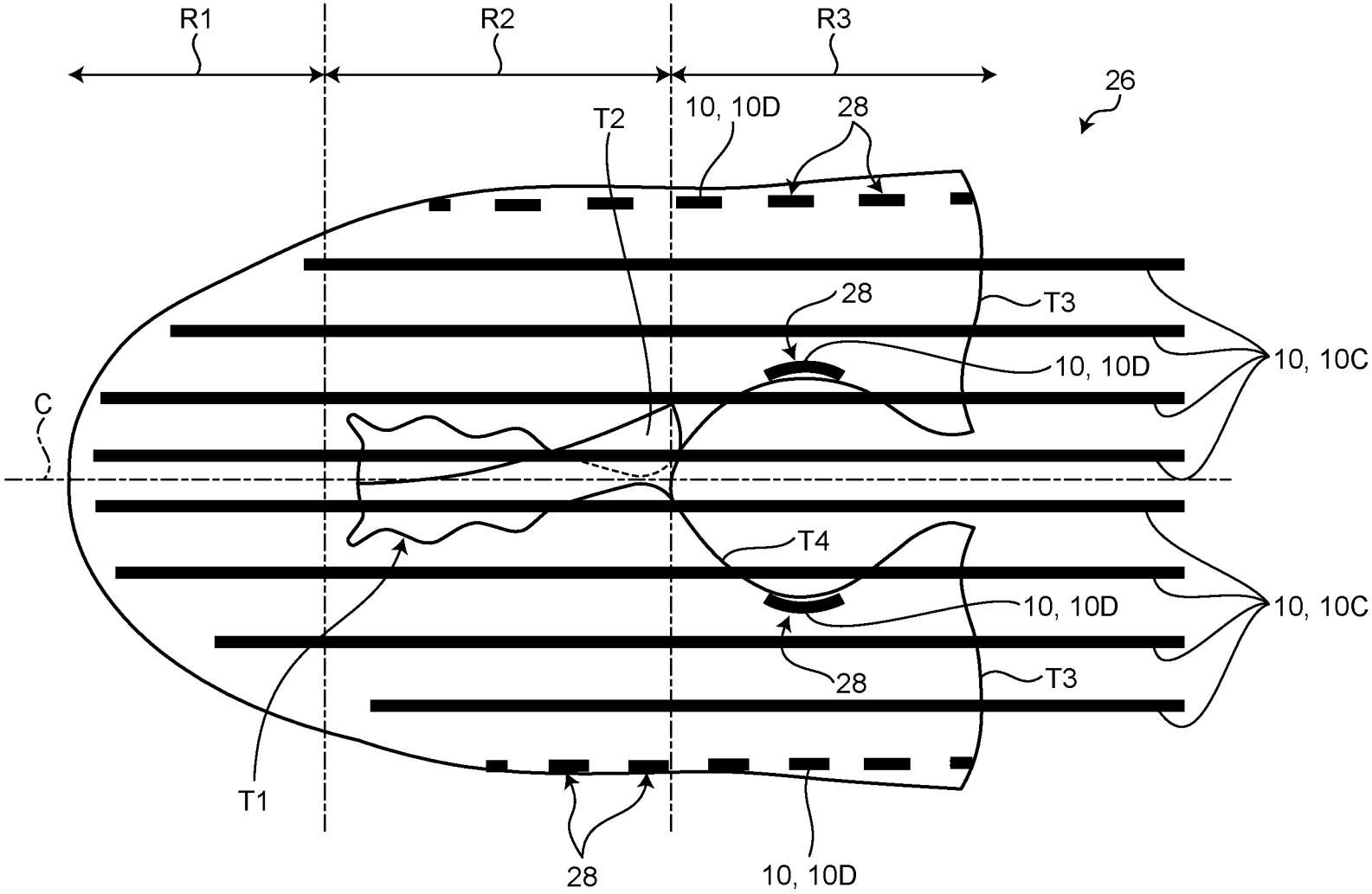
FIG. 6 is a developed view illustrating an upper member of the shoe according to the second embodiment.
Figure 7:
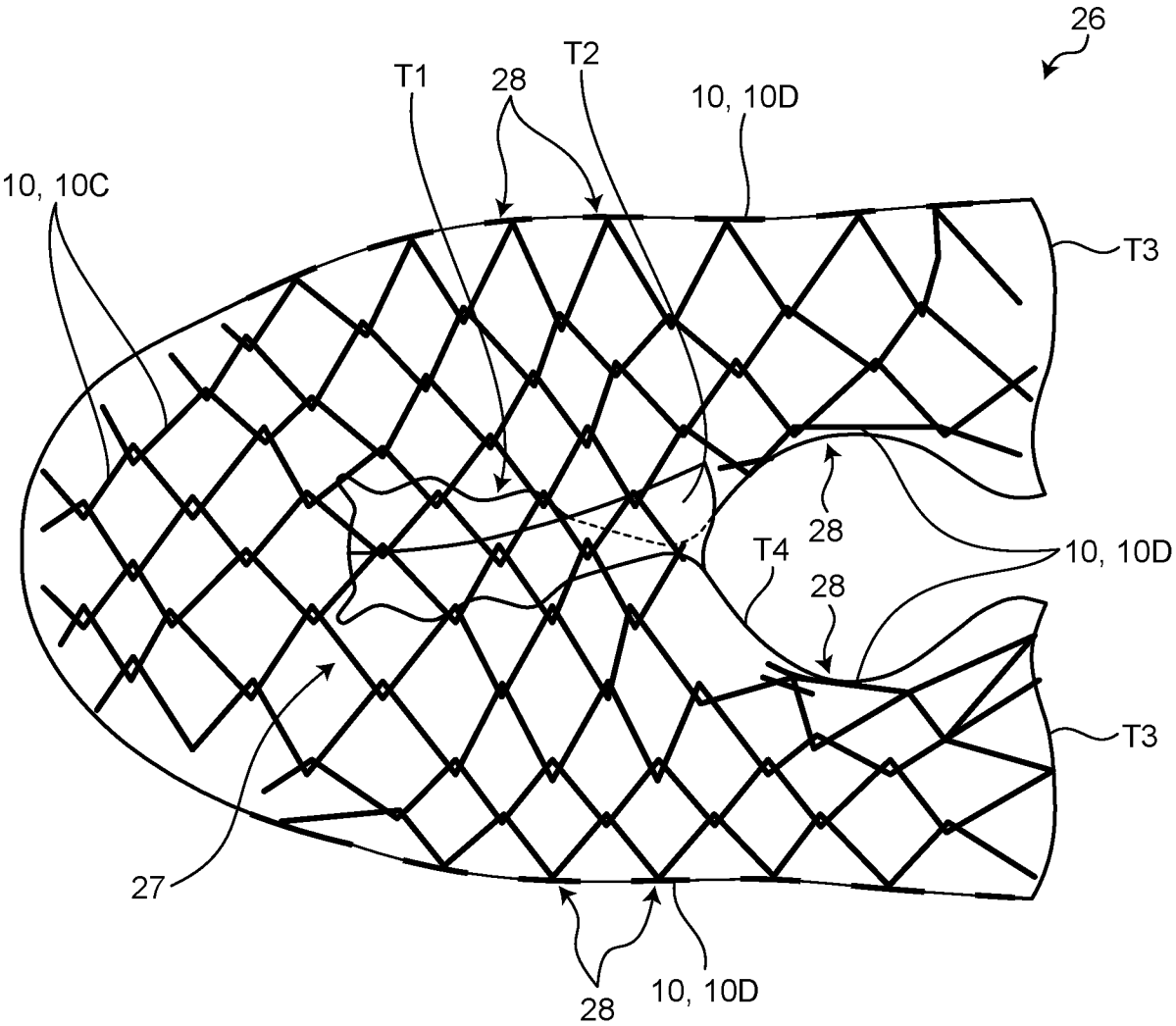
FIG. 7 is a developed view for explaining a string-like body in the second embodiment.

FIG. 5 is a perspective view illustrating an external appearance of a shoe 2 according to a second embodiment. FIG. 6 is a developed view illustrating an upper member 26 of the shoe 2 according to the second embodiment. FIG. 7 is a developed view for explaining string-like bodies 10C and 10D in the second embodiment.

As illustrated in FIGS. 5, 6, and 7, the upper member 26 of the shoe 2 in the second embodiment includes a plurality of string-like bodies 10, which is formed continuously with the upper member 26 by the same thread S as a thread S that forms the upper member 26. The plurality of string-like bodies 10 include a plurality of string-like bodies 10C as first string-like bodies, and a plurality of string-like bodies 10D as second string-like bodies.

The plurality of string-like bodies 10C are covering string-like bodies that cover an outer surface of the upper member 26. The plurality of string-like bodies 10D are attaching string-like bodies for attaching the covering string-like bodies woven in a net shape to the upper member 26. In the upper member 26 in the second embodiment, a net-like body 27, which is formed by weaving the plurality of string-like bodies 10C, is attached by the string-like bodies 10D so as to cover the upper member 26.

Each string-like body 10C is formed by extending in a straight line from an outer circumferential edge portion of an upper fore foot portion R1 of the upper member 26 toward the rear side of the shoe 2. Each of the plurality of string-like bodies 10C is formed to have an appropriate length so as to form the net-like body 27 that covers the outer surface of the upper member 26. The tip portions of the respective string-like bodies 10C, which are woven to form the net-like body 27, are fixed to the upper member 26 by, for example, welding such as thermal fusion, sewing, or bonding, or a combination thereof.

Two of the string-like bodies 10D are disposed along a foot circumferential direction of the upper member 26, that is, along the outer circumferential edges on the medial foot side and the lateral foot side of the upper fore foot portion R1. In addition, as illustrated in FIGS. 6 and 7, two of the string-like bodies 10D are disposed along the outer peripheral portions on the medial foot side and the lateral foot side of a foot insertion opening portion T4 of the upper member 26. In the plurality of string-like bodies 10D, a plurality of insertion holes 28, through which the string-like bodies 10C forming the net-like body 27 are passed, is formed side by side by fixing the string-like bodies 10D to the upper member 26 at a plurality of positions spaced apart in the length direction of the string-like bodies 10. Note that, instead of the string-like bodies 10D forming the insertion holes 28, eyelets (not illustrated), through which the string-like bodies 10C forming the net-like body 27 are passed, may be disposed on the upper member 26.

For example, the tip portions of the string-like bodies 10C, which are passed through the insertion holes 28 of the string-like bodies 10D to form the net-like body 27, are fixed to a heel portion T3 or the like of the upper member 26 by sewing, welding, or bonding, or a combination thereof. In FIG. 5 as an example, the circumference of the string-like bodies 10D and the insertion holes 28 is covered with a cushioning material disposed at the foot insertion opening portion T4 and the sole member 7, but may be exposed to the outside of the shoe 2. In addition, the plurality of string-like bodies 10C may include the string-like bodies 10C that are extended from the heel portion T3 of the upper member 26, which particularly improves the fitting function of the heel portion T3. Note that the net-like body 27 is not limited to the structure, which is disposed to cover the outer surface of the upper member 26, and may be disposed inside an upper member including two layers of cloth-like bodies, for example.

Effects of Second Embodiment

As described above, the upper member 26 of the shoe 2 in the second embodiment includes the plurality of string-like bodies 10C, which forms the net-like body 27 covering the upper member 26, and the plurality of string-like bodies 10D for attaching the net-like body 27 to the upper member 26. As a result, by pulling some string-like bodies 10C among the plurality of string-like bodies 10C forming the net-like body 27, for example, the string-like bodies 10C near a tongue portion T2, it is possible to easily adjust the close contact of the upper member 26 with the foot, and to improve the fitting function.

In addition, in the shoe 2 in the second embodiment, by including the plurality of string-like bodies 10C and 10D, which are formed continuously with the upper member 26 by the same thread S as the thread S that forms the upper member 26, it is also possible to reduce manufacturing energy by reducing the number of parts and to improve recyclability, similarly to the first embodiment.

In the second embodiment, the string-like bodies 10C and the string-like bodies 10D may also have different stretchability or tensile rigidity from each other. In addition, the plurality of string-like bodies 10C may include a plurality of types of string-like bodies 10C having different stretchability or tensile rigidity from each other, which further improves the fitting function of pressing the upper member 26 against the foot by the net-like body 27.

Third Embodiment

Figure 8:
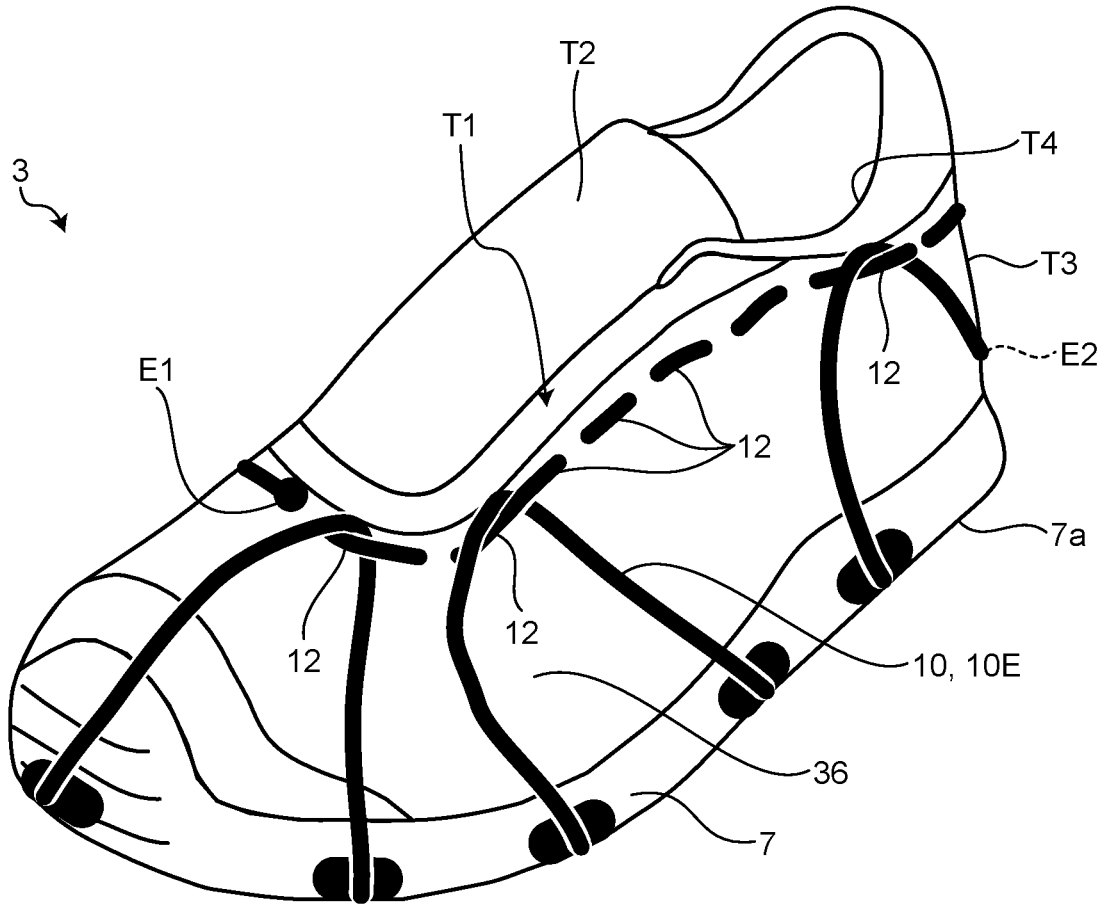
FIG. 8 is a perspective view illustrating a shoe according to a third embodiment.
Figure 9:
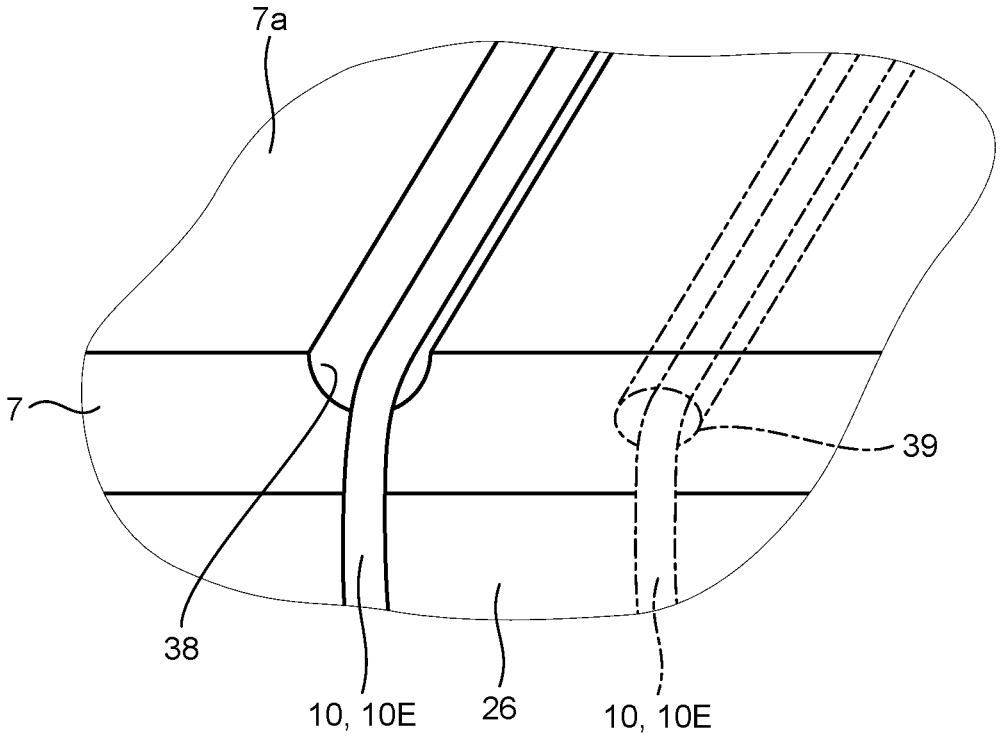
FIG. 9 is an enlarged view schematically illustrating a main part of a sole member in the third embodiment.

FIG. 8 is a perspective view illustrating an external appearance of a shoe 3 according to a third embodiment. FIG. 9 is an enlarged view schematically illustrating a main part of a sole member 7 in the third embodiment.

As illustrated in FIG. 8, an upper member 36 of the shoe 3 in the third embodiment includes a string-like body 10E, which is formed continuously with the upper member 36 by the same thread S as a thread S that forms the upper member 36. The string-like body 10E is formed in such a manner that a starting end E1 is positioned at the center of an outer surface of an upper fore foot portion R1 of the upper member 36, for example, in the vicinity of a throat portion T1 and extends from the starting end E1 to a terminal end E2 (see FIG. 10) of a tip portion. In the shoe 3 in the third embodiment, the sole member 7 is fixed to the upper member 36 by the string-like body 10E, which is disposed across the upper member 36 and the sole member 7.

In addition, the upper member 36 is disposed with a plurality of eyelets 12, through which the string-like body 10E disposed across the upper member 36 and the sole member 7 is passed, side by side along an opening edge portion of the throat portion T1. Among the plurality of eyelets 12 in third embodiment, some eyelets 12 are selectively used depending on the path in which the string-like body 10E is disposed over the upper member 36 and the sole member 7. Note that the eyelets 12 may be formed by a string-like body 10 as in the first embodiment.

As illustrated in FIG. 9, on the fore side and the rear side of a ground contact surface 7*a* of the sole member 7, a plurality of linear recessed portions 38 (see FIG. 10), which extends so as to connect the medial foot side and the lateral foot side, is disposed. The string-like body 10E is passed through along each of the recessed portions 38 and disposed over the upper member 36 and the sole member 7, whereby the upper member 36 and the sole member 7 are fixed. The plurality of recessed portions 38 are disposed in the sole member 7, and some recessed portions 38 among the plurality of recessed portions 38 are selectively used depending on, for example, the orientation of the sole member 7 pressing the sole member 7 against the sole of the foot.

In addition, instead of the recessed portions 38 through which the string-like body 10E is passed, a plurality of through holes 39, which passes through the inside of the sole member 7 from the medial foot side to the lateral foot side, may be linearly disposed, and the string-like body 10E, which is disposed over the upper member 36 and the sole member 7, may be passed through each through hole 39. Note that the upper member 36 and the sole member 7 are not limited to the structure fixed only by the string-like body 10E, and may be fixed by, for example, welding, bonding, or the like in addition to the string-like body 10E.

Figure 10:
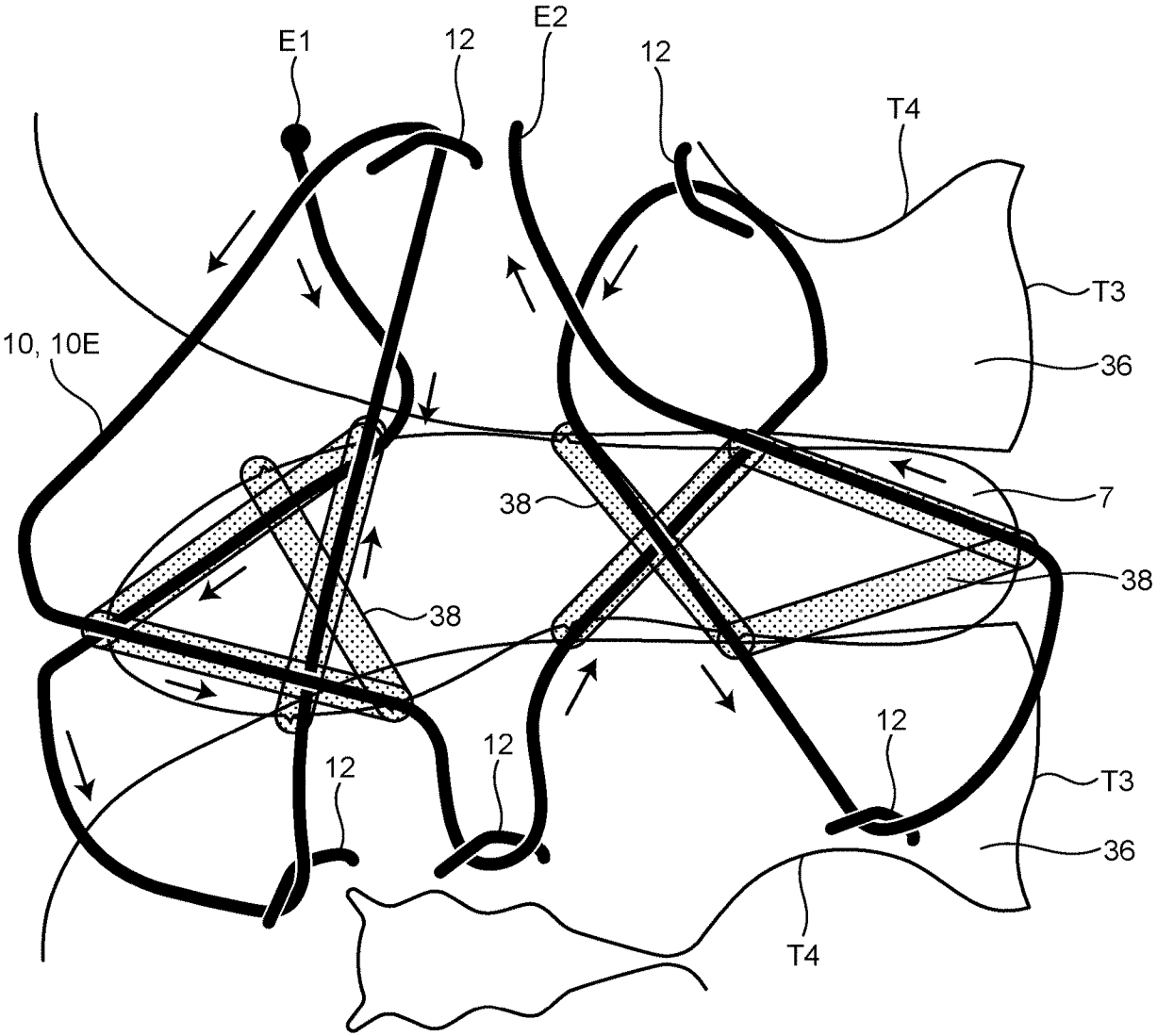
FIG. 10 is a developed view for explaining how a string-like body is disposed in the third embodiment.

FIG. 10 is a developed view for explaining how the string-like body 10E is disposed in the third embodiment. In FIG. 10, for convenience of explanation, a medial foot side portion and a lateral foot side portion of the upper member 36 are illustrated on each side in the foot width direction of the sole member 7, but the medial foot side portion and the lateral foot side portion of the upper member 36, are integrally formed.

As illustrated in FIG. 10 as an example, the string-like body 10E, which is extended from the starting end E1 of the upper member 36, is passed through the recessed portion 38 of the sole member 7 and then passed through the eyelet 12 of the upper member 36, and the string-like body 10E is disposed back and forth between the upper member 36 and the sole member 7 a plurality of times along the path in the order of the arrows in FIG. 10. The terminal end E2 of the string-like body 10E is fixed to the upper member 36 and the sole member 7 by, for example, welding, sewing, or bonding, or a combination thereof. The sole member 7 is fixed to the upper member 36 by the string-like body 10E disposed in this manner, and the close contact of the upper member 36 and the sole member 7 with the foot, is improved by the string-like body 10E.

Effects of Third Embodiment

As described above, the shoe 3 in the third embodiment includes the string-like body 10E that fixes the upper member 36 and the sole member 7. As a result, by detaching the string-like body 10E from the upper member 36 and the sole member 7, it is possible to easily separate the upper member 36 from the sole member 7 and to improve recyclability.

In addition, according to the shoe 3 in the third embodiment, it is possible for the sole member 7 to be pressed against the sole of the foot by the string-like body 10E, which is integrally formed with the upper member 36, and to improve the fitting function. Furthermore, in the shoe 3 in the third embodiment, by disposing the string-like body 10E back and forth between the upper member 36 and the sole member 7 a plurality of times, it is possible to improve the close contact of the upper member 36 and the sole member 7 with the foot and to improve the fitting function. In addition, in the shoe 3 in the third embodiment, by including the plurality of string-like body 10E, which is formed continuously with the upper member 36 by the same thread S as the thread S that forms the upper member 36, it is also possible to reduce manufacturing energy by reducing the number of parts and to improve recyclability, similarly to the first embodiment.

In the third embodiment, one string-like body 10E is disposed, but the number of string-like bodies 10E and the position of the starting end E1 of the string-like body 10E, which is connected to the upper member 36, are not limited, and a plurality of string-like bodies 10E, which has different positions of starting ends E1, may be included, for example. When the plurality of string-like bodies 10E are included in this manner, a plurality of types of string-like bodies 10E, which has different stretchability or tensile rigidity from each other, may be included, whereby further improving the fitting function.

Figure 12:
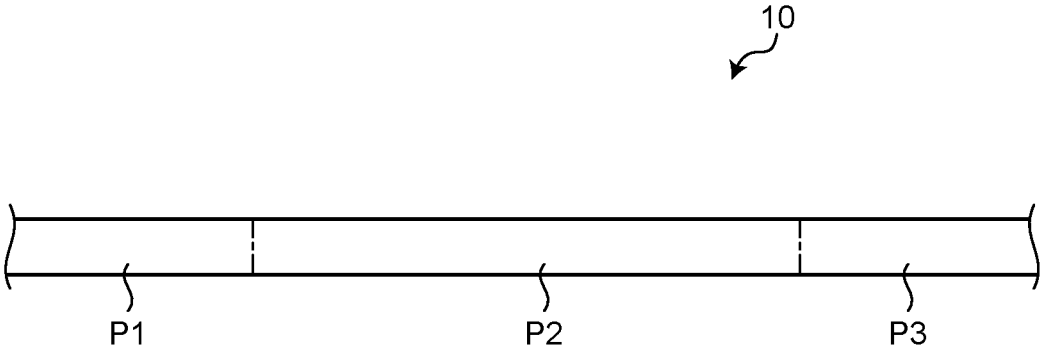
FIG. 12 is a schematic view illustrating a modification of the string-like body in the embodiments.
Figure 13:
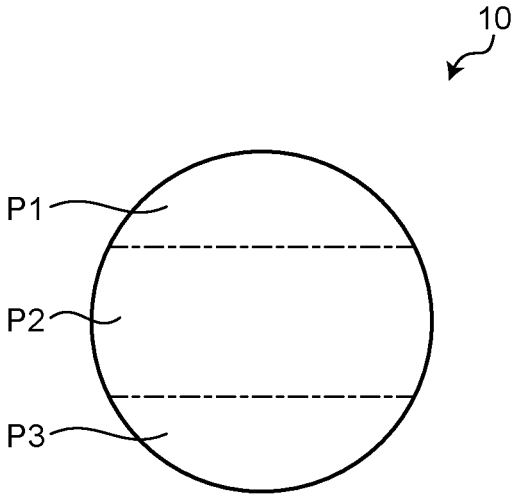
FIG. 13 is a schematic view illustrating another modification of the string-like body in the embodiments.

In addition, one string-like body 10E may have a plurality of types of portions, which has different stretchability or tensile rigidity from each other (see FIGS. 12 and 13). Details of a structure having different stretchability or tensile rigidity in one string-like body, will be described later.

Fourth Embodiment

Figure 11:
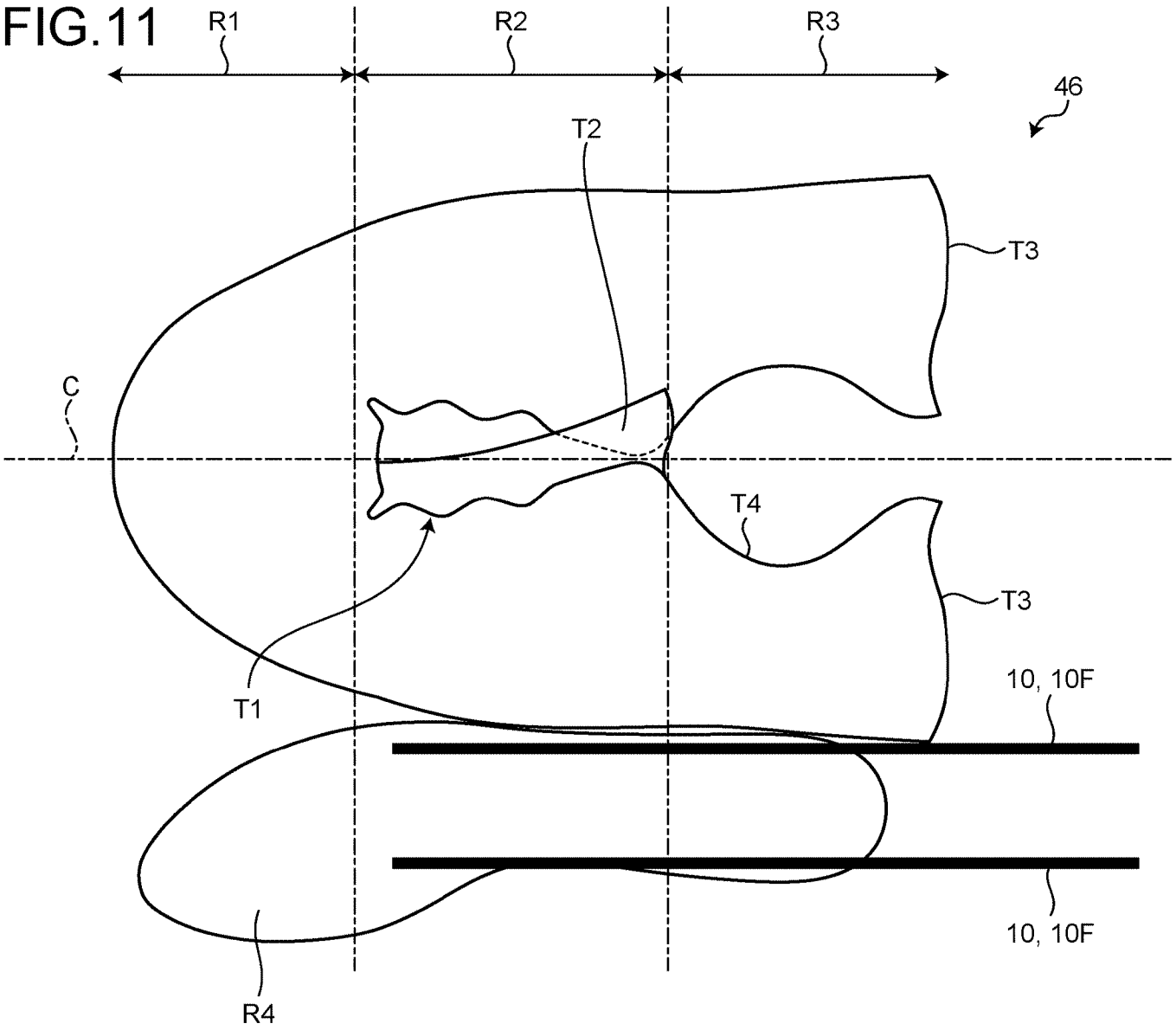
FIG. 11 is a developed view illustrating an upper member of a shoe according to a fourth embodiment.

FIG. 11 is a developed view illustrating an upper member 46 of a shoe according to a fourth embodiment.

As illustrated in FIG. 11, the upper member 46 in the fourth embodiment further includes an upper sole portion R4 as an inner sole portion that covers a sole of a standard foot, in addition to an upper fore foot portion R1, an upper mid foot portion R2, and an upper rear foot portion R3.

The upper sole portion R4 is formed continuously with the upper mid foot portion R2 and the upper rear foot portion R3. The upper sole portion R4 is connected to the lower edge on the medial foot side of the upper mid foot portion R2 and the upper rear foot portion R3. The upper sole portion R4 serves as an inner sole portion that covers a lower opening, which is formed by being surrounded by a lower edge of the upper fore foot portion R1, a lower edge of the upper mid foot portion R2, and a lower edge of the upper rear foot portion R3.

The upper sole portion R4 of the upper member 46 in the fourth embodiment includes string-like bodies 10F, which is formed continuously with the upper member 46 by the same thread S as a thread S that forms the upper sole portion R4. In the upper sole portion R4, two string-like bodies 10F are formed by extending from positions adjacent to the upper mid foot portion R2, and the two string-like bodies 10F are disposed at intervals in the foot width direction of the upper sole portion R4.

The two string-like bodies 10F are disposed along the upper sole portion R4 so as to press the upper sole portion R4 against the sole of the foot. The two string-like bodies 10F are disposed along the upper sole portion R4, then pulled out to the outside of the shoe from, for example, a pull-out hole (not illustrated) disposed in the sole member 7, and tied to eyelets or the like of the upper member 46. As a result, since the upper sole portion R4 is pressed against the sole of the foot by the string-like bodies 10F, the close contact of the upper sole portion R4 with the sole of the foot, is improved.

Note that the string-like bodies 10F are not limited to the structure formed on the upper sole portion R4, and may be formed by extending from, for example, on a medial foot side portion and a lateral foot side portion of the upper member 46, and an effect similar to that in the fourth embodiment, is obtained by disposing the string-like bodies 10F along the upper sole portion R4. In addition, the fourth embodiment does not limit the number of string-like bodies 10F.

Effects of Fourth Embodiment

As described above, the upper member 46 of the shoe in the fourth embodiment includes the upper sole portion R4, and the string-like bodies 10F, which is disposed along the upper sole portion R4 so as to press the upper sole portion R4 against the sole of the foot. As a result, since the close contact of the upper sole portion R4 with the sole of the foot is improved by the string-like bodies 10F, it is possible to improve the fitting function.

In addition, in the shoe in the Fourth embodiment, by including the plurality of string-like bodies 10F, which is formed continuously with the upper member 46 by the same thread S as a thread S that forms the upper sole portion R4 of the upper member 46, it is also possible to reduce manufacturing energy by reducing the number of parts and to improve recyclability, similarly to the first embodiment.

Modification

Finally, a modification of the string-like body 10 (10A to 10F) in each of the above-described first to fourth embodiments will be described. FIG. 12 is a schematic view illustrating a modification of the string-like body 10 in the embodiments, and is an enlarged view illustrating a part of the string-like body 10 in the length direction. FIG. 13 is a schematic view illustrating another modification of the string-like body 10 in the embodiments, and is an enlarged view illustrating a cross section of the string-like body 10 orthogonal to the length direction.

As illustrated in FIGS. 12 and 13, the string-like body 10 includes a plurality of types of portions P1, P2, and P3, which has different stretchability or tensile rigidity from each other in one string-like body 10. As illustrated in FIG. 12, in the string-like body 10, the portions P1, P2, and P3, which has different stretchability or tensile rigidity from each other, are disposed side by side in the length direction of the string-like body 10. Therefore, the string-like body 10 can achieve appropriate stretchability or tensile rigidity for each portion in the length direction.

As illustrated in FIG. 13, in the string-like body 10, a plurality of types of portions P1, P2, and P3, which has different stretchability or tensile rigidity from each other, is disposed side by side in the transverse section orthogonal to the length direction of the string-like body 10 along one direction of the transverse section of the string-like body 10. That is, the portion P2 is positioned between the portions P1 and P3 in the transverse section of the string-like body 10. The string-like body 10, formed in this manner, can achieve, when disposed along the surface of the upper member 6 (26, 36, 46), appropriate stretchability or tensile rigidity on the side in contact with the upper member 6 and the side opposite to the upper member 6.

In addition, when a plurality of string-like bodies 10 is disposed on the upper member 6 and the like, the plurality of string-like bodies 10 may include a plurality of types of string-like bodies 10, which has the same cross-sectional shape orthogonal to the length direction of the string-like bodies 10 and different cross-sectional areas orthogonal to the length direction from each other. In other words, the plurality of string-like bodies 10 may include, for example, a plurality of types of string-like bodies 10, which has different thicknesses such as flat strings and round strings, whereby the appropriate stretchability or tensile rigidity can be achieved depending on the use of each string-like body 10. Here, the thicknesses of the string-like bodies 10 refer to the thickness or width of a flat string when the string-like bodies 10 are the flat strings, and refer to the outer diameter of a round string when the string-like bodies 10 are the round strings.

In addition, when a plurality of string-like bodies 10 is disposed on the upper member 6 and the like, the plurality of string-like bodies 10 may include a plurality of types of string-like bodies 10, which has different cross-sectional shapes orthogonal to the length direction of the string-like bodies 10 from each other. In other words, the plurality of string-like bodies 10 may include, for example, a plurality of types of string-like bodies 10, which has different cross-sectional shapes such as flat strings and round strings, whereby the appropriate stretchability or tensile rigidity can be achieved depending on the use of each string-like body 10.

When the stretchability or tensile rigidity of the string-like bodies 10 is made different as described above, by changing the combination of threads S that forms the string-like bodies 10 among the threads forming the upper member 6 or by adding another thread S, it is possible to easily make the stretchability or the tensile rigidity different.

Effects of Modification

As described above, according to the modification, since the appropriate stretchability or tensile rigidity can be achieved depending on each portion of one string-like body 10, or the appropriate stretchability or tensile rigidity can be achieved depending on the use of each string-like body 10 formed on the upper member 6 (26, 36, 46) or the like, it is possible to further achieve easy handling of the string-like body 10, and improve the fitting function by the string-like body 10.

Hereinafter, various aspects of the present disclosure are described.

A shoe according to a first aspect includes an upper member covering a foot, and a string-like body formed continuously with the upper member by the same thread as a thread forming the upper member.

A shoe according to a second aspect includes, in the shoe according to the first aspect, a shoelace formed by the string-like body.

A shoe according to a third aspect includes, in the shoe according to the first or second aspect, an eyelet formed by the string-like body.

An eyelet of a shoe according to a fourth aspect, in which the string-like body having one end formed continuously on the upper member is fixed to the upper member by the other end in the shoe according to the third aspect.

An eyelet of a shoe according to a fifth aspect is, in the shoe according to the third aspect, formed by the string-like body having both ends formed continuously on the upper member A shoe according to a sixth aspect further includes, in the shoe according to any one of the first to fifth aspects, a sole member attached to the upper member, in which the upper member and the sole member are fixed by the string-like body.

A sole member of a shoe according to a seventh aspect includes, in the shoe according to the sixth aspect, a recessed portion or a through hole through which the string-like body is passed.

A shoe according to an eighth aspect, in which the upper member further includes, in the shoe according to the sixth or seventh aspect, an eyelet through which the string-like body is passed.

An upper member of a shoe according to a ninth aspect is, in the shoe according to the first aspect, formed with a plurality of the string-like bodies, and a net-like body covering the upper member is formed by weaving the plurality of string-like bodies.

A plurality of string-like bodies of a shoe according to a tenth aspect includes, in the shoe according to the ninth aspect, a first string-like body forming the net-like body, and a second string-like body disposed along a circumferential direction of the foot. The second string-like body is formed with a plurality of insertion holes through which the first string-like body is passed, by being fixed to the upper member at a plurality of positions spaced apart in a length direction of the second string-like body.

A shoe according to an eleventh aspect, in which the upper member includes, in the shoe according to the ninth or tenth aspect, a heel portion covering a heel of the foot. The plurality of string-like bodies includes the string-like body disposed on the heel portion.

A shoe according to a twelfth aspect, in which the upper member includes, in the shoe according to any one of the first to fifth aspects, an inner sole portion. The string-like body is disposed along the inner sole portion so as to press the inner sole portion against a sole of the foot.

A shoe according to a thirteenth aspect, in which the upper member is, in the shoe according to any one of the first to twelfth aspects, formed with a plurality of the string-like bodies. The plurality of string-like bodies includes a plurality of types of string-like bodies having different stretchability or tensile rigidity from each other.

A shoe according to a fourteenth aspect, in which the string-like body includes, in the shoe according to any one of the first to thirteen aspects, a plurality of types of portions having different stretchability or tensile rigidity from each other in one string-like body.

A shoelace of a shoe according to a fifteenth aspect includes, in the shoe according the second aspect, a tip portion extended from the upper member, hardness of the tip portion being higher than hardness of a portion other than the tip portion.

A shoe according to a sixteenth aspect, in which the upper member is, in the shoe according to any one of the first to fifteenth aspects, formed with a plurality of the string-like bodies. The plurality of string-like bodies includes a plurality of types of string-like bodies having the same cross-sectional shape orthogonal to a length direction of the string-like body and different cross-sectional areas orthogonal to the length direction from each other.

A shoe according to a seventeenth aspect, in which the upper member is, in the shoe according to any one of the first to sixteenth aspects, formed with a plurality of the string-like bodies. The plurality of string-like bodies includes a plurality of types of string-like bodies having a different cross-sectional shape orthogonal to the length direction from each other.

A shoe according to the present disclosure has effects of ensuring a fitting function, reducing manufacturing energy by reducing the number of parts, and improving recyclability.

Although the present disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A shoe comprising:

an upper member, which covers a foot;

a string-like body, which is formed continuously with the upper member by the same thread as a thread that forms the upper member; and an eyelet which is formed by the string-like body;

wherein in the eyelet, the string-like body has one end formed continuously on the upper member and another end which is fixed to the upper member by one or more of welding, sewing, or bonding.

2. The shoe according to claim 1, comprising a shoelace formed by a second one of the string-like body.

3. The shoe according to claim 2, wherein the shoelace includes a tip portion, which is extended from the upper member, hardness of the tip portion being higher than hardness of a portion other than the tip portion.

4. The shoe according to claim 1, further comprising:

a sole member, which is attached to the upper member, wherein the upper member and the sole member are fixed by another one of the string-like body.

5. The shoe according to claim 4, wherein the sole member includes a recessed portion or a through hole, through which the string-like body is passed.

6. The shoe according to claim 1, wherein the upper member is formed with a plurality of the string-like bodies, and a net-like body, which covers the upper member, is formed by weaving the plurality of string-like bodies.

7. The shoe according to claim 6, wherein the plurality of string-like bodies includes a first string-like body, which forms the net-like body, and a second string-like body, which is disposed along a circumferential direction of the foot, and the second string-like body is formed with a plurality of insertion holes through which the first string-like body is passed, by being fixed to the upper member at a plurality of positions spaced apart in a length direction of the second string-like body.

8. The shoe according to claim 6, wherein the upper member includes a heel portion, which covers a heel of the foot, and the plurality of string-like bodies includes the string-like body, Which is disposed on the heel portion.

9. The shoe according to claim 1, wherein the upper member includes an inner sole portion, and the string-like body is disposed along the inner sole portion so as to press the inner sole portion against a sole of the foot.

10. The shoe according to claim 1, wherein the upper member is formed with a plurality of the string-like bodies, and the plurality of string-like bodies includes a plurality of types of string-like bodies, which has different stretchability or tensile rigidity from each other.

11. The shoe according to claim 1, wherein the string-like body includes a plurality of types of portions, which have different stretchability or tensile rigidity from each other in one string-like body.

12. The shoe according to claim 1, wherein the upper member is formed with a plurality of the string-like bodies, and the plurality of string-like bodies includes a plurality of types of string-like bodies, which has the same cross-sectional shape orthogonal to a length direction of the string-like body and different cross-sectional areas orthogonal to the length direction from each other.

13. The shoe according to claim 1, wherein the upper member is formed with a plurality of the string-like bodies, and the plurality of string-like bodies includes a plurality of types of string-like bodies, which has a different cross-sectional shape orthogonal to the length direction from each other.

* * * * *